US006032875A

United States Patent [19]

Grimshaw-Jones

[11] Patent Number: 6,032,875

[45] Date of Patent: Mar. 7, 2000

[54] LUBRICATED HEAVY DIESEL FUEL PUMP WITH PRECIPITATE BUILD-UP INHIBITING FEATURES

[75] Inventor: Stanley G. Grimshaw-Jones, Edmonton, Canada

[73] Assignee: Caterpillar Inc., Peoria, Ill.

[21] Appl. No.: 09/063,918

[22] Filed: Apr. 21, 1998

[51] Int. Cl.[7] ..... B05B 15/02; F23D 11/34

[52] U.S. Cl. ..... 239/106; 239/123; 239/92

[58] Field of Search ..... 239/104, 106, 239/114–116, 123, 88–92; 92/158, 159, 208

[56] References Cited

U.S. PATENT DOCUMENTS

| | | | |
|---|---|---|---|
| 1,837,813 | 12/1931 | Groff . | |
| 1,850,250 | 3/1932 | Von Salis . | |
| 2,225,796 | 12/1940 | Perrine . | |
| 2,759,771 | 8/1956 | Grigar . | |
| 2,884,919 | 5/1959 | Butler . | |
| 2,932,865 | 4/1960 | Bauer . | |
| 3,153,987 | 10/1964 | Thoma . | |
| 4,304,410 | 12/1981 | Erickson et al. . | |
| 4,350,082 | 9/1982 | Carrens | 92/159 |
| 4,599,935 | 7/1986 | Ellermann et al. . | |
| 4,809,591 | 3/1989 | Rhodes et al. . | |
| 4,903,580 | 2/1990 | Bruni . | |
| 5,076,226 | 12/1991 | Watanabe et al. | 123/193 P |
| 5,460,329 | 10/1995 | Sturman | 239/96 |
| 5,816,134 | 10/1998 | Takenaka et al. | 92/154 |
| 5,826,561 | 10/1998 | Mack et al. | 123/446 |

*Primary Examiner*—Andres Kashnikow
*Assistant Examiner*—Lisa Ann Douglas
*Attorney, Agent, or Firm*—Michael B. McNeil

[57] ABSTRACT

A heavy diesel fuel injection pump with precipitate build-up inhibiting features includes a pump body that defines a plunger bore. The plunger has a top end separated from a bottom end by a side surface, and is moveable in the plunger bore between a retracted position and an advanced position. A portion of the plunger bore and the bottom end of the plunger define a pump chamber containing heavy diesel fuel. The top end of the plunger is exposed to lubricating oil. The lubricating oil mixes with the heavy diesel fuel along a guide portion of the side surface of the plunger that has a tight clearance with respect to the plunger bore. At least one of the pump body and the guide portion of the plunger define a plurality of cleaning grooves located adjacent the guide portion. The cleaning grooves are sized and shaped to continuously scrape clean calcium carbonate precipitates from the plunger bore wall and plunger outer surface, and provide a volume in which the solids can accumulate until a subsequent maintenance cycle for a particular pump.

20 Claims, 2 Drawing Sheets

LUBRICATED HEAVY DIESEL FUEL PUMP WITH PRECIPITATE BUILD-UP INHIBITING FEATURES

TECHNICAL FIELD

The present invention relates generally to lubricated heavy diesel fuel pumps, and more particularly to heavy diesel fuel injection pumps having precipitate build-up inhibiting features.

BACKGROUND ART

Heavy diesel fuel refers generally to the material that is left over after crude oil has been distilled. Heavy diesel fuel typically has viscosity somewhere on the order of road tar at ambient temperatures, and must normally be heated to temperatures in excess of 400° Fahrenheit in order to make the same sufficiently flowable through a fuel injection pump. Due in part to the extremely high viscosity of heavy diesel fuel, the current state of the art in relatively large diesel engines continues to be cam actuated fuel injection pumps. In order to prevent the plunger from sticking or seizing, a lubricant, such as lubricating oil, must often be employed. In some cases, the lubricant itself can be a source of plunger sticking and seizures due to the formation of precipitates where the lubricating oil comes in contact with the heavy diesel fuel. One such precipitate includes the build-up of calcium carbonate in a plunger bore where heavy diesel fuel has migrated up the side of the plunger into contact with the lubricating oil.

Because there is often a relatively tight clearance between the reciprocating plunger and its bore, only a small amount of calcium carbonate build-up is necessary to cause the plunger to seize. Because of this problem, heavy diesel fuel injection pumps are periodically removed, disassembled, and cleaned in order to remove any calcium carbonate build-up. Depending upon what constituent chemicals are present in both the lubricating oil and the heavy diesel fuel, plunger seizures can occur in literally a matter of hours when calcium carbonate build-ups are high. More often, heavy diesel fuel injectors must typically be disassembled and cleaned about every one thousand hours of operation.

The present invention is directed to these and other problems associated with precipitate build-up in heavy diesel fuel injection pumps.

DISCLOSURE OF THE INVENTION

A lubricated heavy diesel fuel pump with precipitate build-up inhibiting features includes a pump body that defines a plunger bore. A plunger with a first end separated from a second end by a side surface is positioned in the plunger bore and moveable between a retracted position and an advanced position. A portion of the plunger bore and the first end of the plunger define a pump chamber containing heavy diesel fuel. The second end of the plunger is exposed to lubricating oil, which mixes with the heavy diesel fuel along a portion of the plunger's side surface. At least one of the pump body and plunger define at least one cleaning groove located adjacent the portion of the side surface of the plunger.

BEST MODE FOR CARRYING OUT THE INVENTION

Figure 1:
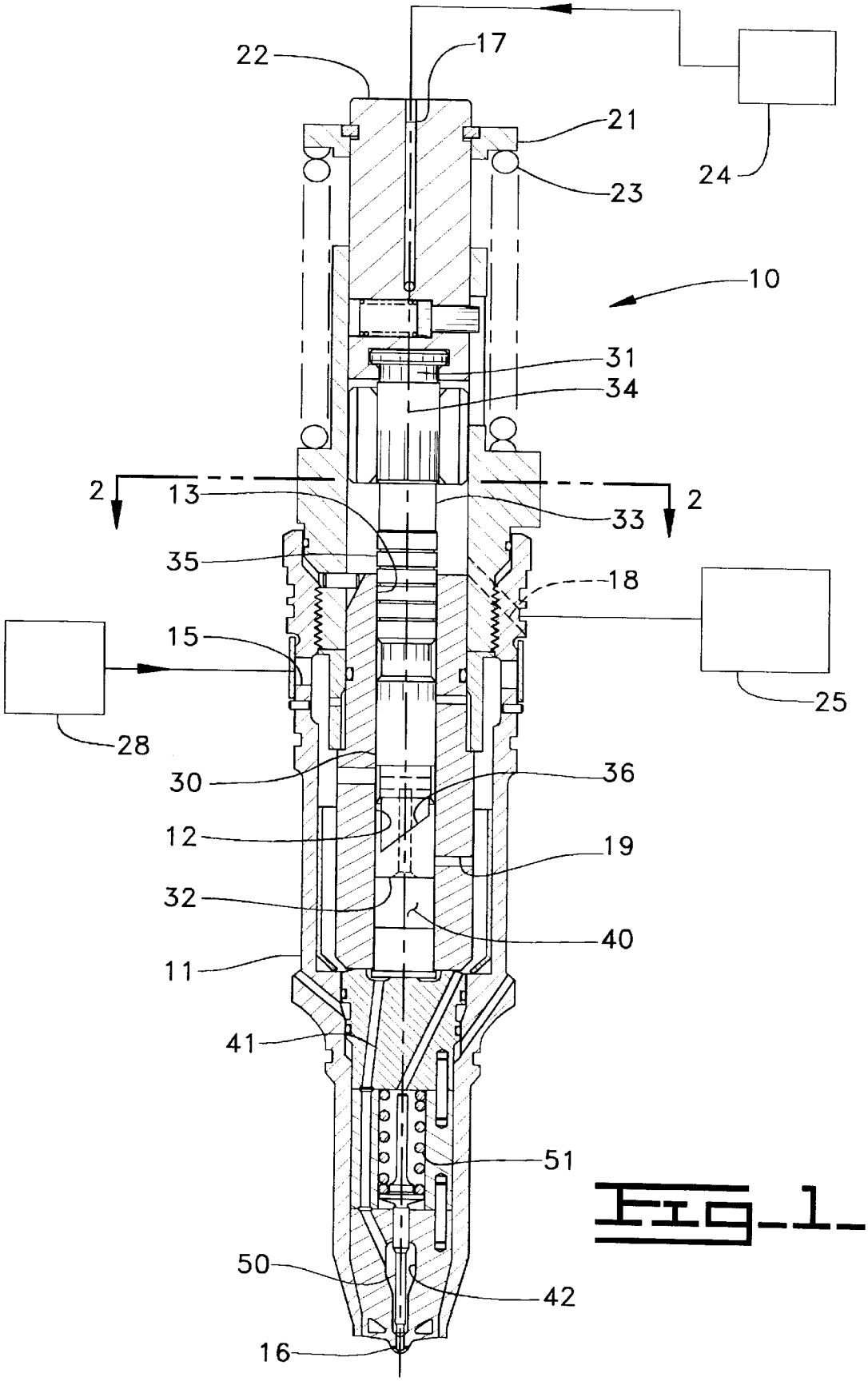
FIG. 1 is a sectioned side elevational diagrammatic view of a heavy diesel fuel injector according to the present invention.
Figure 2:
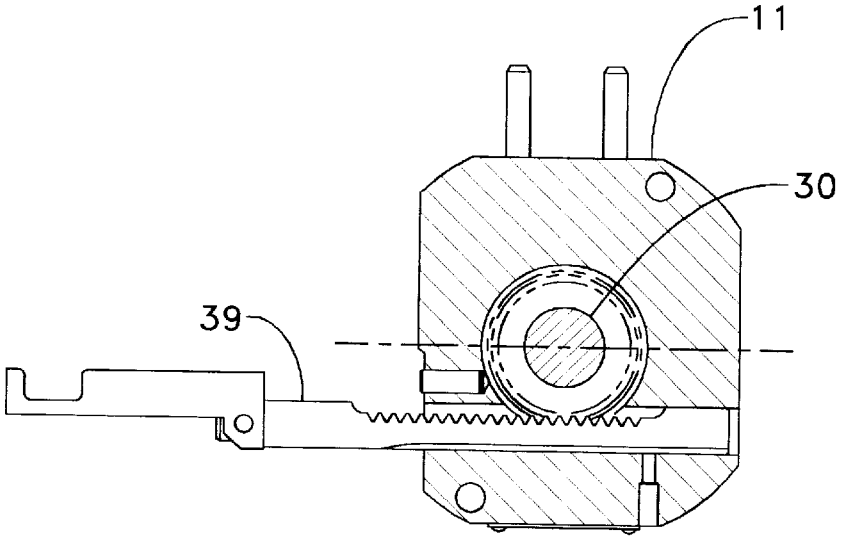
FIG. 2 is a top sectioned diagrammatic view of the fuel injector of FIG. 1 as viewed along section lines 2—2.
Figure 3:
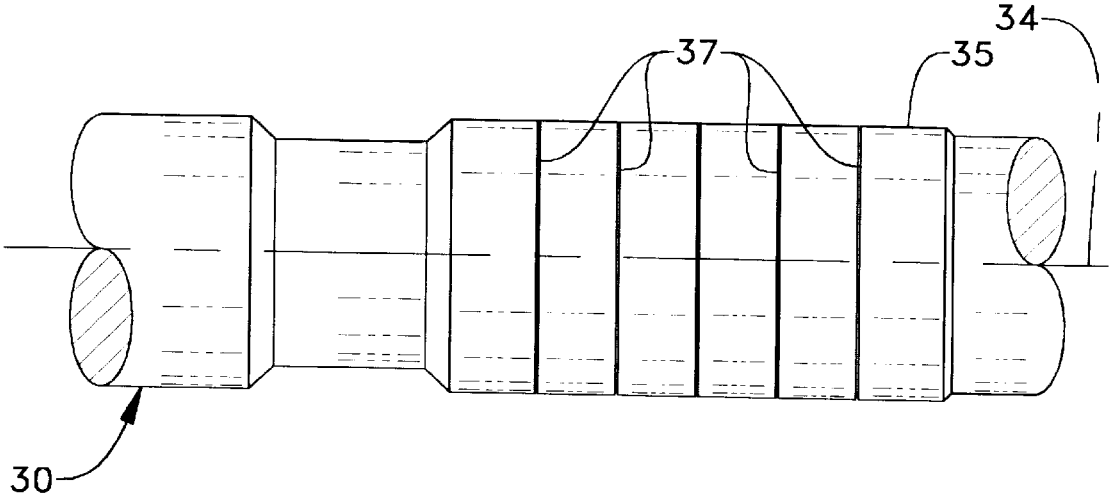
FIG. 3 is an enlarged partial side diagrammatic view of a plunger according to one aspect of the present invention.
Figure 4:
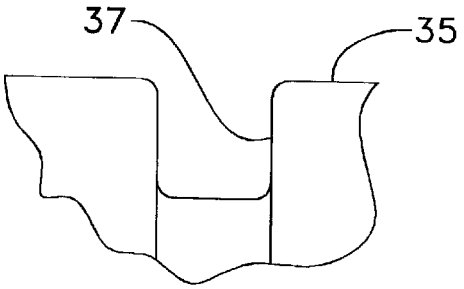
FIG. 4 is an enlarged partial view of a guide portion with grooves according to present invention.

Referring now to FIGS. 1–3, a heavy diesel fuel injector 10 includes a pump body 11 that defines a plunger bore 12. Pump body 11 also defines a nozzle outlet and a heavy diesel fuel inlet 15 connected to a source of heavy diesel fuel 28. A plunger is positioned in plunger 12 and is moveable between a retracted position, as shown, and an advanced position with each pumping cycle of fuel injector 10. Plunger 30 includes a top end 31 separated from a bottom end 32 by a side surface 33. Plunger 30 moves along a plunger centerline 34 and has a generally cylindrical shape. The bottom end 32 of plunger 30 and a portion of plunger bore 12 define a fuel pressurization chamber 40 that is in fluid communication with a nozzle chamber 42 via a nozzle connection passage 41.

A needle valve member 50 is positioned in pump body 11 and is moveable between an inject position in which nozzle chamber 42 is open to nozzle outlet 16, and a closed position in which nozzle chamber 42 is blocked to nozzle outlet 16. Needle valve member 50 is biased toward its closed position by a needle return spring 51. As in a conventional injector that uses distillate fuel, an amount of heavy diesel fuel enters pump body 11 when plunger 30 is undergoing its upward return stroke. An amount of fuel is pumped out of nozzle outlet 16 with each downward pumping stroke of plunger 30. The amount of fuel that leaves nozzle outlet 16 with each pumping stroke of plunger 30 is determined by the orientation of helical fuel spill slot 36 with regard to fuel spill passage 19. This angular orientation is controlled by a fuel metering rack and pinion device 39 in a convention manner.

The top end 31 of plunger 30 is attached to a tappet 21. Tappet 21 includes a rocker arm contact surface 22 that defines a lubricating oil inlet 17 which is connected to a source of lubricating oil 24. In order to maintain plunger 30 appropriately lubricated, engine lubricating oil enters at oil inlet 17, circulates around first end 31 and along side surface 33, and eventually leaks back out of pump body 11 through lubricating oil outlet 18. The oil then eventually returns to the oil sump 25 for recirculation in a conventional manner. Both tappet 21 and plunger 30 are retracted between injection events by a tappet return spring 23.

Side surface 33 of plunger 30 includes a guide portion 35 that has a relatively tight clearance with respect to guide bore portion 13 of plunger bore 12. Because of the relatively tight clearance in this area, there is a need for lubrication in order to prevent plunger 30 from becoming stuck. Although lubricating oil is at a relatively low pressure when supplied to injector 10, some of the lubricating oil finds its way into guide bore portion 13 in order to maintain proper lubricity around guide portion 35. Unfortunately, lubricating oil has a tendency to react with heavy diesel fuel and produce precipitates, especially calcium carbonate deposits wherever the two liquids come in contact. Because of the relatively high pressures experienced in pump chamber 40 during an injection event, over time an amount of heavy diesel fuel will migrate up the side surface 33 of plunger 30 and come in contact with downward migrating lubricating oil in the area of guide bore portion 13.

In order to prevent the build-up of calcium carbonate and other possible precipitates that can cause plunger seizure, guide portion 35 of the present invention includes five spaced apart cleaning grooves 37. As plunger 30 reciprocates up and down, the edges of cleaning grooves 37 continuously scrape guide bore portion 13 free of calcium carbonate precipitate deposits. In addition to providing an edge by which these deposits can be continuously cleaned from the bore wall, the volume defined by the cleaning grooves provides a location where the deposits can accumulate without undermining the performance of heavy diesel fuel injector 10. In order to prevent the introduction of unnecessary stress points produced by right angles on plunger 30, grooves 37 preferably have a unshaped bottom and slightly rounded edges.

Industrial Applicability

There are several competing considerations that need to be taken into account when one is determining the size, shape and number of cleaning grooves for a particular heavy diesel fuel injection pump. In order to prevent binding and insure that plunger 30 continues to move along centerline 34, it is important that guide portion 35 have a relatively large surface contact area. Thus, the accumulated widths of all of the cleaning grooves 37 subtract some measurable amount from this surface area. On the other hand, the cleaning grooves must have sufficient widths to provide a scrape surface edge instead of becoming plugged quickly with calcium carbonate build-up. Experimental efforts have shown that cleaning groove widths greater than about 0.1 millimeter will not become plugged, but it is generally desired that the widths be less than 0.5 millimeters in order to preserve a maximum guide surface contact area on guide portion 35.

Another consideration is the depth of the cleaning grooves 37. Here again, conflicting considerations are at work. If the cleaning grooves are too shallow, there is insufficient volume available for the accumulation of precipitate solids, and therefore, injector 10 would still have to be disassembled and cleaned almost as often as if there were no grooves at all, as in the prior art. On the other hand, if the depth of cleaning grooves 37 is too deep, the strength of plunger 30 can be undermined and high stress points can be created, which could eventually lead to plunger breakage. It has been found that creating cleaning grooves with a depth of greater than about 0.1 millimeter but less than 0.5 millimeters provides an adequate volume for the accumulation of precipitate solids without seriously undermining the strength of plunger 30.

Another consideration is how many cleaning grooves should be provided. While the preferred embodiment shows annular cleaning grooves that lay in planes perpendicular to centerline 34, some other arrangement could be provided. One such possibility could be a single helically shaped cleaning groove that encircles plunger 30 about four or five times along its length. Another desirable possibility might be a double, oppositely oriented, helix configuration. Such a configuration would allow scraping to take place both when the plunger is reciprocating and when it is rotating due to the metering function. In any event, it is preferable that the cleaning grooves be equally spaced apart and spread out over the length of guide portion 35 in order to minimize the impact on the guide surface area. It has been found that five equally spaced cleaning grooves has worked better than three equally spaced cleaning grooves. However, it is possible that six or more spaced apart cleaning grooves could perform satisfactorily.

Another consideration is the prevention of the entry of heavy diesel fuel into the lubricating oil flow circuit in order to prevent the creation and deposit of calcium carbonate precipitates at other locations within an internal combustion engine. It has been found that the use of five spaced apart cleaning grooves as shown in FIG. 3 provides a continuous cleaning function of the present invention, and does so without significantly raising the amount of heavy diesel fuel that makes its way into the lubricating oil circuitry of the engine. Even with the cleaning grooves of the present invention, fuel injector 10 will periodically need to be disassembled and the accumulated solids in the cleaning grooves 37 removed in any suitable manner known in the art. However, it is believed that by including cleaning grooves according to the present invention, the time between these maintenance cycles for a given injector can be greatly increased over that of prior art heavy diesel fuel injection pumps.

The above description is intended for illustrative purposes only, and is not intended to limit the scope of the present invention in any way. For instance, those skilled in the art will appreciate that the cleaning grooves of the present invention could also be made on the inner guide bore portion of the pump body instead of on the outer surface of the plunger as shown in the preferred embodiment. In addition, in order to obtain the maximum benefit of the cleaning grooves according to the present invention, it is desirable that the grooves sweep out the complete length of the guide bore portion 13 with each reciprocation of plunger 30 during normal loaded operating conditions of the engine in which injector 10 is mounted. Thus, various modifications could be made to the disclosed embodiment without departing from the intended spirit and scope of the present invention, which is defined in terms of the claims as set forth below.

We claim:

1. A lubricated heavy diesel fuel pump with precipitate build-up inhibiting features, comprising:

a pump body defining a plunger bore;

a plunger with a first end separated from a second end by a side surface, and being positioned in said plunger bore and moveable between a retracted position and an advanced position;

a portion of said plunger bore and said first end of said plunger defining a pump chamber containing heavy diesel fuel;

said second end of said plunger being exposed to lubricating oil and;

at least one of said pump body and plunger defining at least one cleaning groove located adjacent said portion of said side surface.

2. The pump of claim 1 wherein a portion of said side surface is a guide portion with a tight clearance with respect to said plunger bore; and said guide portion defining a plurality of cleaning grooves.

3. The pump of claim 1 wherein said at least one cleaning groove is annular and lies in a plane perpendicular to a centerline of said plunger.

4. The pump of claim 1 wherein said portion has a length; and said at least one cleaning groove sweeps over said length when said plunger moves between said retracted position and said advanced position.

5. The pump of claim 1 wherein said at least one cleaning groove has a width greater than 0.1 mm but less than 0.5 mm.

6. The pump of claim 1 wherein said at least one cleaning groove has a depth greater than 0.1 mm but less than 0.5 mm.

7. The pump of claim 1 wherein said portion defines at least five spaced apart annular cleaning grooves that lie in planes perpendicular to a centerline of said plunger and having widths greater than 0.1 mm.

8. The pump of claim 1 wherein said pump body defines a nozzle outlet in fluid communication with said pump chamber; and a needle valve member positioned in said pump body and being moveable between an inject position in which said nozzle outlet is open, and a closed position in which said nozzle outlet is blocked.

9. A heavy diesel fuel injection pump with precipitate build-up inhibiting features, comprising:

a pump body defining a plunger bore;

a plunger with a first end separated from a second end by a side surface, and being positioned in said plunger bore and moveable between a retracted position and an advanced position;

a portion of said plunger bore and said first end of said plunger defining a pump chamber containing heavy diesel fuel;

said second end of said plunger being exposed to lubricating oil; a guide portion of said side surface having a tight clearance with respect to said plunger bore; and at least one of said pump body and said guide portion of said plunger defining a plurality of cleaning grooves located adjacent said guide portion.

10. The heavy diesel fuel injection pump of claim 9 wherein said plurality of cleaning grooves are annular and lie in planes perpendicular to a centerline of said plunger.

11. The heavy diesel fuel injection pump of claim 9 wherein said guide portion has a length; and said plurality of cleaning grooves sweep over said length when said plunger moves between said retracted position and said advanced position.

12. The heavy diesel fuel injection pump of claim 9 wherein said plurality of cleaning grooves have widths greater than 0.1 mm but less than 0.5 mm.

13. The heavy diesel fuel injection pump of claim 9 wherein said plurality of cleaning grooves have depths greater than 0.1 mm but less than 0.5 mm.

14. The heavy diesel fuel injection pump of claim 9 wherein said guide portion defines at least five spaced apart annular cleaning grooves that lie in planes perpendicular to a centerline of said plunger and having widths greater than 0.1 mm.

15. The heavy diesel fuel injection pump of claim 9 wherein said pump body defines a nozzle outlet in fluid communication with said pump chamber; and a needle valve member positioned in said pump body and being moveable between an inject position in which said nozzle outlet is open, and a closed position in which said nozzle outlet is blocked.

16. A heavy diesel fuel injection pump with precipitate build-up inhibiting features, comprising:

a pump body defining a plunger bore in fluid communication with a nozzle outlet;

a plunger with a first end separated from a second end by a side surface, and being positioned in said plunger bore and moveable between a retracted position and an advanced position;

a portion of said plunger bore and said first end of said plunger defining a pump chamber containing heavy diesel fuel;

said second end of said plunger being exposed to lubricating oil;

at least one of said pump body and plunger defining at least one cleaning groove located adjacent said portion of said side surface; and a needle valve member positioned in said pump body and being moveable between an inject position in which said nozzle outlet is open, and a closed position in which said nozzle outlet is blocked.

17. The heavy diesel fuel injection pump of claim 16 wherein a portion of said side surface defines a plurality of cleaning grooves that are annular and lie in planes perpendicular to a centerline of said plunger.

18. The heavy diesel fuel injection pump of claim 17 wherein said portion has a length; and said plurality of cleaning grooves sweep over said length when said plunger moves between said retracted position and said advanced position.

19. The heavy diesel fuel injection pump of claim 18 wherein said plurality of cleaning grooves is at least five cleaning grooves having widths greater than 0.1 mm.

20. The heavy diesel fuel injection pump of claim 19 wherein said plurality of cleaning grooves have depths greater than 0.1 mm.

* * * * *